US011326818B2

(12) United States Patent
Lqli et al.

(10) Patent No.: US 11,326,818 B2
(45) Date of Patent: May 10, 2022

(54) RECEIVER FOR COOLING SYSTEM

(71) Applicant: SCHNEIDER ELECTRIC IT CORPORATION, Foxboro, MA (US)

(72) Inventors: Qiang Lqli, Changzhou (CN); Min Jin, Shanghai (CN); Qiang Meng, Shanghai (CN); Bo Hong, Shanghai (CN)

(73) Assignee: SCHNEIDER ELECTRIC IT CORPORATION, Foxboro, MA (US)

( * ) Notice: Subject to any disclaimer, the term of this patent is extended or adjusted under 35 U.S.C. 154(b) by 0 days.

(21) Appl. No.: 16/801,695

(22) Filed: Feb. 26, 2020

(65) Prior Publication Data

US 2020/0278139 A1 Sep. 3, 2020

(51) Int. Cl.
*F25B 43/00* (2006.01)

(52) U.S. Cl.
CPC ..... *F25B 43/006* (2013.01); *F25B 2400/01* (2013.01); *F25B 2400/16* (2013.01)

(58) Field of Classification Search
CPC . F25B 2400/16; F25B 2400/01; F25B 43/006
See application file for complete search history.

(56) References Cited

U.S. PATENT DOCUMENTS 4,384,460 A 5/1983 Vakil
4,476,028 A * 10/1984 Harris ..... B01D 17/0214 210/774
5,758,514 A * 6/1998 Genung ..... F25B 13/00 62/471
2004/0194491 A1* 10/2004 Park ..... F25B 43/006 62/275
2005/0132729 A1* 6/2005 Manole ..... F25B 1/10 62/149
2008/0173637 A1* 7/2008 Taguchi ..... H05B 3/50 219/523

FOREIGN PATENT DOCUMENTS

EP 1437564 A1 7/2004
EP 3173714 A1 5/2017

OTHER PUBLICATIONS

Extended European Search Report from corresponding European Application No. 20159492.6 dated Jul. 27, 2020.

* cited by examiner

*Primary Examiner* — Elizabeth J Martin
(74) *Attorney, Agent, or Firm* — Lando & Anastasi, LLP

(57) ABSTRACT

A receiver of a cooling unit includes a cylindrical body having a cylindrical wall that defines an interior chamber, a bottom wall formed with the cylindrical wall, and a top wall formed with the cylindrical wall. The receiver further includes an inlet provided in the cylindrical body, an outlet provided in the cylindrical body, a heater well disposed within the cylindrical body, and a heater positioned in the heater well to selectively heat a heat transfer fluid contained within the interior chamber of the cylindrical body. The heater well can be configured to extend from the top wall to adjacent the bottom wall along an axis that is coaxial with an axis of the cylindrical wall of the cylindrical body or extend horizontally adjacent the bottom wall of the cylindrical body.

15 Claims, 6 Drawing Sheets

RECEIVER FOR COOLING SYSTEM

CROSS-REFERENCE TO RELATED APPLICATION

This application claims the benefit under 35 U.S.C. § 119 of Chinese Patent Application No. 201910152109.X filed Feb. 28, 2019 which is hereby incorporated herein by reference in its entirety for all purposes.

BACKGROUND OF DISCLOSURE

1. Field of Disclosure

The technical field relates generally to cooling systems, and more particularly, a receiver for a cooling system that includes a heating element.

2. Discussion of Related Art

Economical systems for heat removal may combine different methods for transporting heat away from an indoor space, such as a computer room or data center. For instance, heat exchange between indoor and outdoor spaces can be facilitated using different transport fluids and cooling devices.

One example of a method for heat removal combines an air-cooled computer room air conditioner (CRAC) with a condenser, and is typically referred to as an air-cooled CRAC DX system. The "DX" designation stands for direct expansion and refers to any system that uses refrigerant and an evaporator coil to create a cooling effect. The refrigerant may be a chlorinated fluorocarbon or halogenated chlorofluorocarbon or ammonia. Air-cooled CRAC units can be used in IT environments and are typically configured such that half the components of the refrigeration cycle are in the CRAC and the rest are outdoors in the air-cooled condenser. Heat from the IT environment is "pumped" to the outdoor environment using a circulating flow of refrigerant. A compressor may reside in the CRAC unit or in the condenser.

Free cooling refers to cooling techniques in which low external air temperatures are used to assist in cooling operations. Airside free cooling introduces cold outside air directly into the IT room or data center when atmospheric conditions allow. Waterside free cooling uses an additional cooling coil containing glycol that circulates directly from the fluid cooler when atmospheric conditions allow. Free cooling methods may be either direct or indirect. Direct free cooling refers to a cooling technique where air sourced from an external environment, such as the outdoors, is mixed directly with hot air sourced from an internal environment, such as a room in a building. In contrast, indirect free cooling refers to a cooling technique where air sourced from an external environment is mixed indirectly with hot air sourced from an internal environment. One example of indirect free cooling combines an air duct with an indirect air evaporative cooler. This system uses outdoor air as the heat transport fluid to indirectly cool data center air when the temperature outside is lower than a temperature set point of the IT environment inlet air. Fans blow cold outside air through an air-to-air heat exchanger, which in turn cools the hot data center air on the other side of the heat exchanger, thereby completely isolating the data center air from the outside air.

One or more heat removal methods may be used to cool a computer room or data center environment. The primary differentiator between methods of heat removal may reside in the way each collects and transports heat to the outside atmosphere. When combined, these differences can sometimes lead to one or more mechanical problems, as well as increased energy consumption.

Such a DX cooling system includes many components, including a receiver, which is provided for storing heat transfer fluid, e.g., R-134a coolant, used in the cooling system for operating a DX condenser. The liquid receiver can be configured to store at least a portion of coolant depending on fluctuating changes in the pressure of the cooling system and can function to flood the heat exchanger using flooding valve. The flooding valve functions to maintain a steady or minimum liquid pressure and/or temperature of the coolant in the cooling system. In one embodiment, the receiver collects the coolant when the pressure in the DX cooling system is low. Thus, it may be necessary to heat the coolant in the receiver to increase the suction pressure. In one embodiment, heater tape can be applied to an outer surface of the receiver with a zip tie. This known approach in heating the receiver coolant is shown in FIG. 1. As shown, a receiver 1 has heater tape 2 installed at a customer sight, and requires insulation around the receiver to be removed. A more sophisticated and effective manner to heat the coolant is desired.

SUMMARY OF DISCLOSURE

One aspect of the disclosure is directed to a receiver of a cooling unit. In one embodiment, the receiver comprises a cylindrical body having a cylindrical wall that defines an interior chamber, a bottom wall formed with the cylindrical wall, and a top wall formed with the cylindrical wall. The receiver further comprises an inlet provided in the cylindrical body, an outlet provided in the cylindrical body, a heater well disposed within the cylindrical body, and a heater positioned in the heater well to selectively heat a heat transfer fluid contained within the interior chamber of the cylindrical body.

Embodiments of the receiver further may include positioning the heater well to extend from the top wall to adjacent the bottom wall along an axis that is coaxial with an axis of the cylindrical wall of the cylindrical body. The heater may be positioned at a bottom of the heater well. The heater may extend horizontally adjacent the bottom wall of the cylindrical body. The heater may be a polymer positive temperature coefficient heating element. The receiver further may include a heater wire connected to the heater and configured to power the heater. The heater wire may be connected to a controller configured to control the operation of the heater. The receiver further may include a strain relief plug configured to seal the heater well. The inlet may be provided in the top wall and the outlet is provided in the top wall.

Another aspect of the present disclosure is directed to a method of selectively heating heat transfer fluid in a receiver of a cooling unit. In one embodiment, the method comprising: providing a receiver including a cylindrical body having a cylindrical wall that defines an interior chamber, a bottom wall formed with the cylindrical wall, and a top wall formed with the cylindrical wall, an inlet provided in the cylindrical body, an outlet provided in the cylindrical body, and a heater well disposed within the cylindrical body; positioning a heater in the heater well; and selectively powering the heater to heat a heat transfer fluid contained in the receiver.

Embodiments of the method further may include positioning the heater well to extend from the top wall to adjacent the bottom wall along an axis that is coaxial with the cylindrical wall of the cylindrical body. The heater may be positioned at a bottom of the heater well. The heater may extend horizontally adjacent the bottom wall of the cylindrical body. The heater may be a polymer positive temperature coefficient heating element. The method further may include connecting the heater to a heater wire to provide power the heater. The method further may include connecting the heater wire to a controller configured to control the operation of the heater. The method further may include sealing the heater well with a strain relief plug configured to seal the heater well. The inlet may be provided in the top wall and the outlet is provided in the top wall.

Yet another aspect is directed to a cooling unit comprising a housing, a compressor supported by the housing, a condenser supported by the housing and in fluid communication with the compressor, and a receiver supported by the housing and in fluid communication with the compressor and the condenser. The receiver includes a cylindrical body having a cylindrical wall that defines an interior chamber, a bottom wall formed with the cylindrical wall, and a top wall formed with the cylindrical wall. The receiver further includes an inlet provided in the cylindrical body, an outlet provided in the cylindrical body, a heater well disposed within the cylindrical body, a heater positioned in the heater well, and a heater wire connected to the heater and configured to power the heater. The heater wire is connected to a controller configured to control the operation of the heater to selectively heat a heat transfer fluid contained within the interior chamber of the cylindrical body. The receiver further includes a strain relief plug configured to seal the heater well.

Embodiments of the cooling unit further may include positioning the heater well to extend from the top wall to adjacent the bottom wall along an axis that is coaxial with an axis of the cylindrical wall of the cylindrical body. The heater may be positioned at a bottom of the heater well, the heater being a polymer positive temperature coefficient heating element.

Still other aspects, embodiments, and advantages of these example aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. Embodiments disclosed herein may be combined with other embodiments, and references to "an embodiment," "an example," "some embodiments," "some examples," "an alternate embodiment," "various embodiments," "one embodiment," "at least one embodiment," "this and other embodiments," "certain embodiments," or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF DRAWINGS

Various aspects of at least one embodiment are discussed below with reference to the accompanying figures, which are not intended to be drawn to scale. The figures are included to provide an illustration and a further understanding of the various aspects and embodiments, and are incorporated in and constitute a part of this specification, but are not intended as a definition of the limits of any particular embodiment. The drawings, together with the remainder of the specification, serve to explain principles and operations of the described and claimed aspects and embodiments. In the figures, each identical or nearly identical component that is illustrated in various figures is represented by a like numeral. For purposes of clarity, not every component may be labeled in every figure. In the figures:

DETAILED DESCRIPTION

Cooling systems for removing heat in conditioned spaces such as IT environments use heat transport fluids such as air, water, or refrigerant to transport heat energy from indoors to outdoors. Many cooling systems rely on the refrigeration cycle as the primary means of cooling. Pumped refrigerant systems provide isolation between the primary heat removal system and IT equipment. The direct air and indirect air methods rely on the outdoor conditions as the primary means of cooling, which makes them more efficient for mild climates.

In some embodiments, the space being cooled is a data center or IT environment. A data center may include one or more rooms or spaces that contain rows of equipment racks designed to house electronic equipment, such as data processing, networking, and telecommunications equipment. During operation the electronic equipment generates heat that needs to be removed to ensure the continued performance, reliability, and useful life of the equipment components housed by the equipment racks. One or more embodiments of the systems disclosed herein are designed to remove heat produced by the electronic equipment within the data center and return cool air back to the data center.

Figure 1:
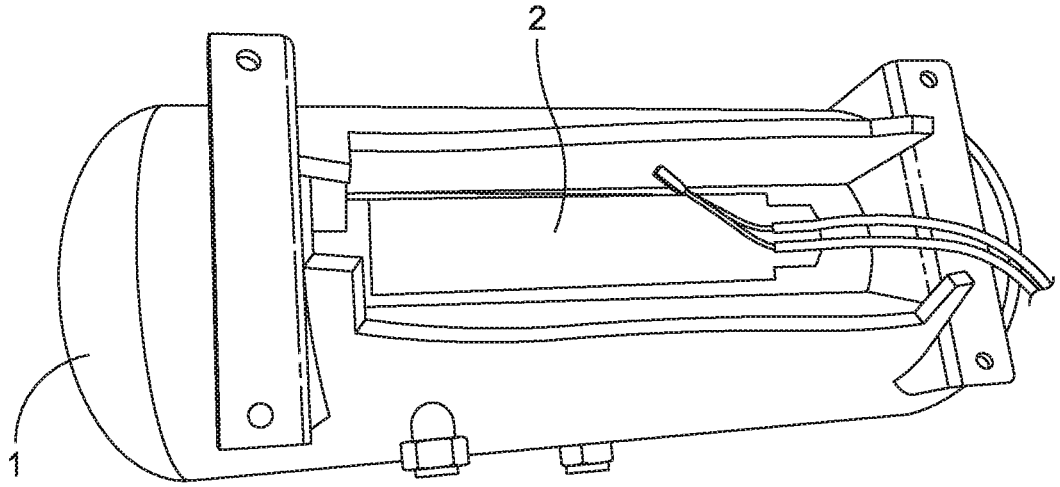
FIG. 1 (PRIOR ART)
FIG. 1 is a view of a traditional receiver having heat tape applied thereto.
Figure 2:
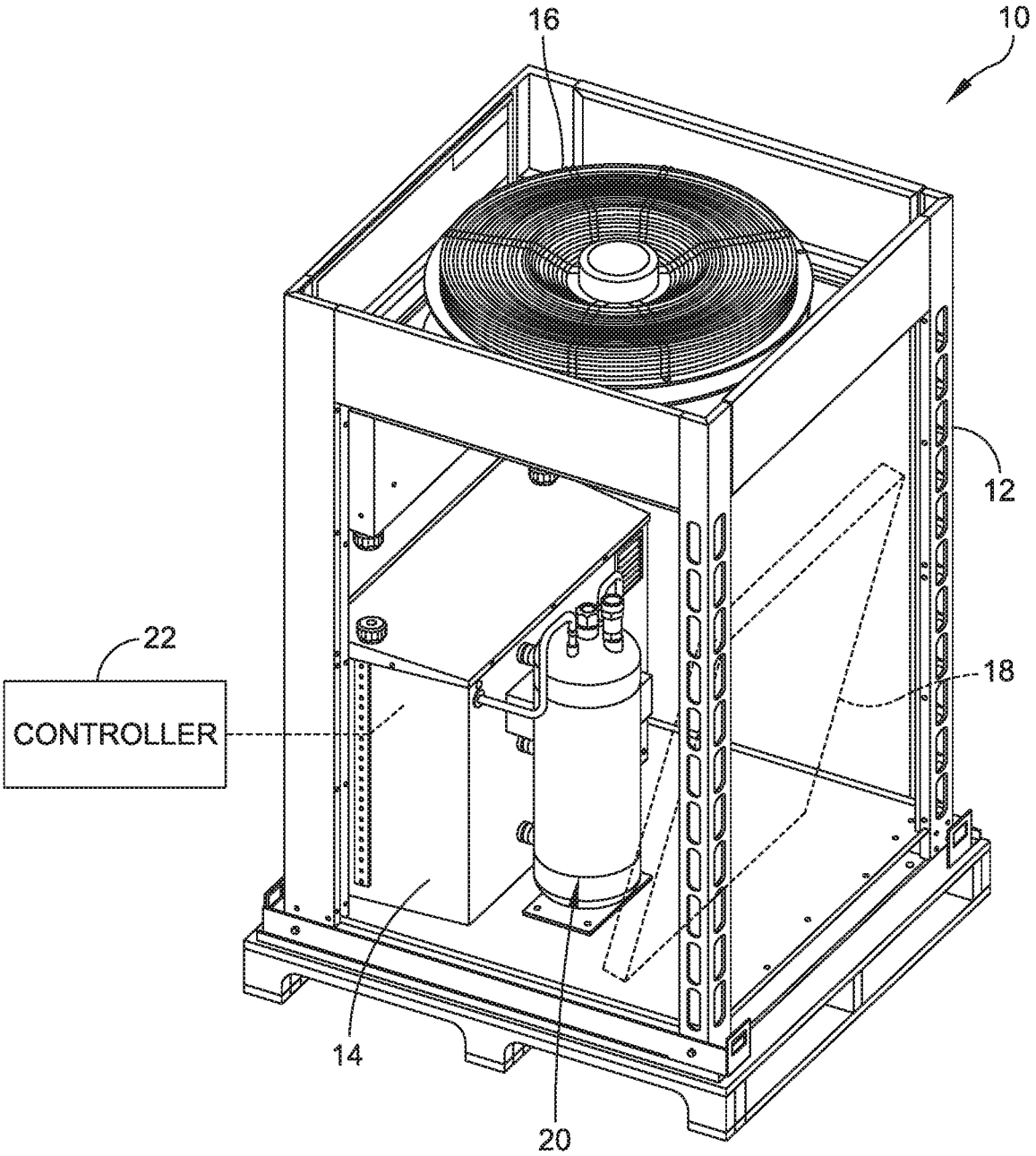
FIG. 2 is a perspective view of a cooling unit having a receiver of an embodiment of the present disclosure.

One example of a method for heat removal in an IT environment includes a cooling system having a DX cooling unit. In this type of system, the refrigeration cycle components may be positioned in an enclosure external to the space being cooled and a heat exchanger may be positioned in the space being cooled. The heat exchanger uses refrigerant to collect heat from the DX cooling unit and transports it away from the IT environment. Referring to FIG. 2, a portion of a cooling system shows one example of a cooling system that includes a DX cooling unit, generally indicated at 10. The DX cooling unit 10 includes a housing 12, a compressor 14, a fan unit 16, a DX condenser, indicated by dashed lines 18, and a receiver, generally indicated at 20. The DX condenser 18 of the DX cooling unit is shown in dashed lines to show the important components of the unit, including the receiver 20. As described above, the receiver 20 is a tank for storing heat transfer fluid used in the DX cooling unit 10 for operating the DX condenser 18. The receiver 20 can be configured to store at least a portion of heat transfer fluid depending on fluctuating changes in the pressure of the cooling system. Although not explicitly shown in FIG. 2, the DX cooling unit 10 also includes one or more pumps or compressors for pumping heat transfer fluid within the DX cooling unit.

The DX cooling unit 10 may also include a controller 22 that functions to control one or more components of the DX cooling unit. For instance, the controller 22 may control one or more operating parameters of the compressor 14, the DX condenser 18, and other components of the unit 10, including the receiver 20. Sensors (not shown) may be located in DX cooling unit 10 that are configured to measure operating parameters, such as flow rate, temperature, and pressure. The sensors may send input signals to the controller 22 that are then used by the controller to control components of the DX cooling unit 10. For instance, the sensors may be used to control the components of DX cooling unit 10 in one or more operating modes.

Figure 3:
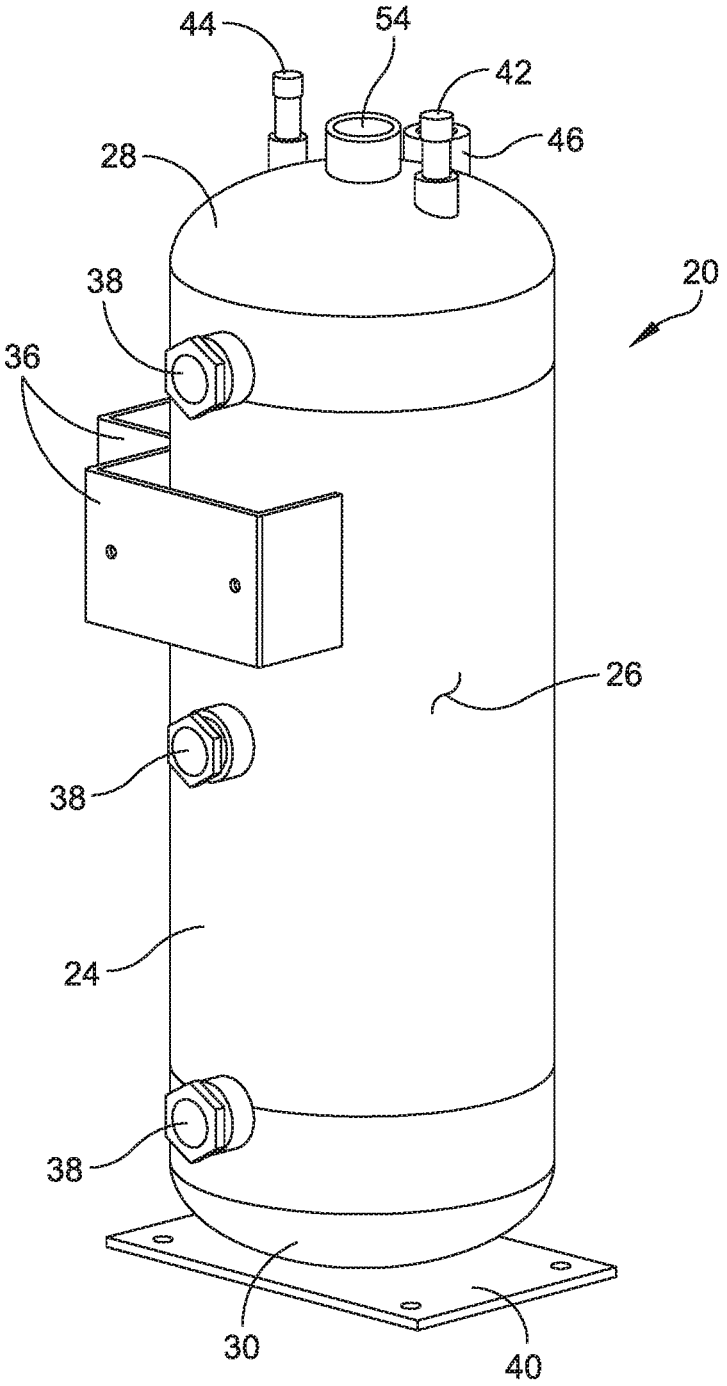
FIG. 3 is a perspective view of the receiver shown in FIG. 2.
Figure 4:
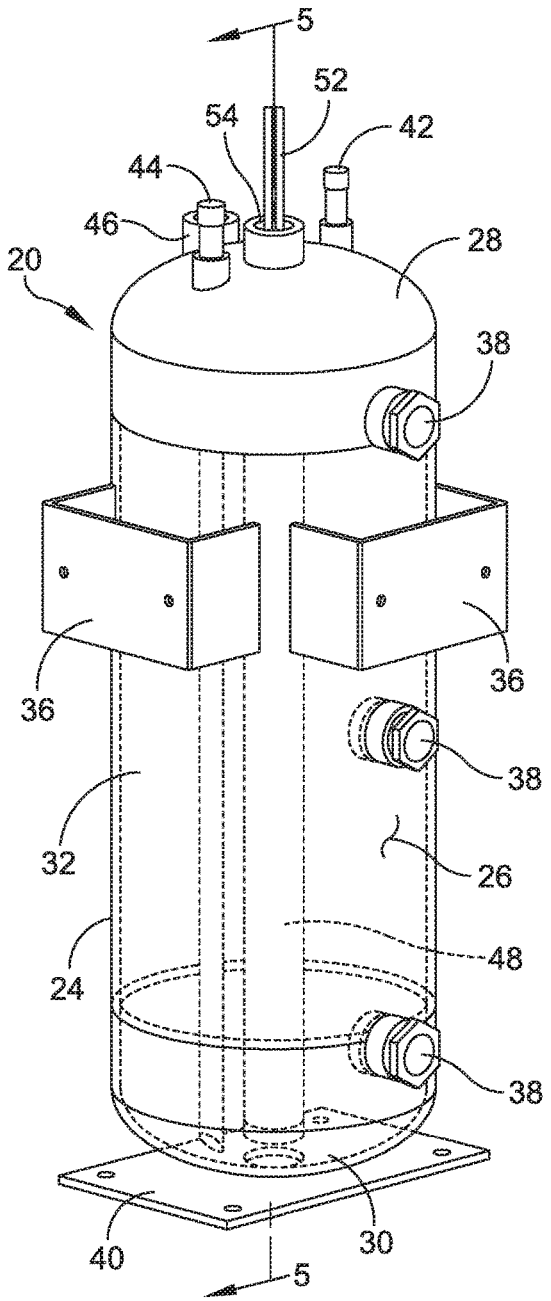
FIG. 4 is a perspective view of the receiver showing with a cylindrical wall of the receiver being translucent to reveal an interior of the receiver.

Referring to FIGS. 3 and 4, the receiver 20 includes a cylindrical body 24 that is fabricated from a suitable metal, such as stainless steel. The cylindrical body 24 includes a cylindrical wall 26, a curved top wall 28 provided at the top of the cylindrical wall, and a curved bottom wall 30 provided at the bottom of the cylindrical wall. In one embodiment, the top wall 28 and the bottom wall 30 are domed- or spherically-shaped. Together, the cylindrically wall 26, the top wall 28, and the bottom wall 30 define an interior chamber 32 (FIG. 5) that is designed to hold and store heat transfer fluid 34. As mentioned above, the receiver 20 is designed to receive, store and deliver a heat transfer fluid, such as R-134a coolant.

As shown, the cylindrical wall 26 includes two brackets, each indicated at 36, to secure the receiver 20 to a component of the DX cooling unit 10, such as a housing of the compressor 14. The cylindrical wall 26 further includes three ports, each indicated at 38, which are provided for showing the liquid level of refrigerant. The cylindrical body 24 is mounted on a base 40 that is configured to support the cylindrical body of the receiver 20 in an upright position shown in FIGS. 2-6. In one embodiment, the base 40 is mounted on or otherwise secured to a bottom of the housing 12 of the DX cooling unit 10.

Figure 5:
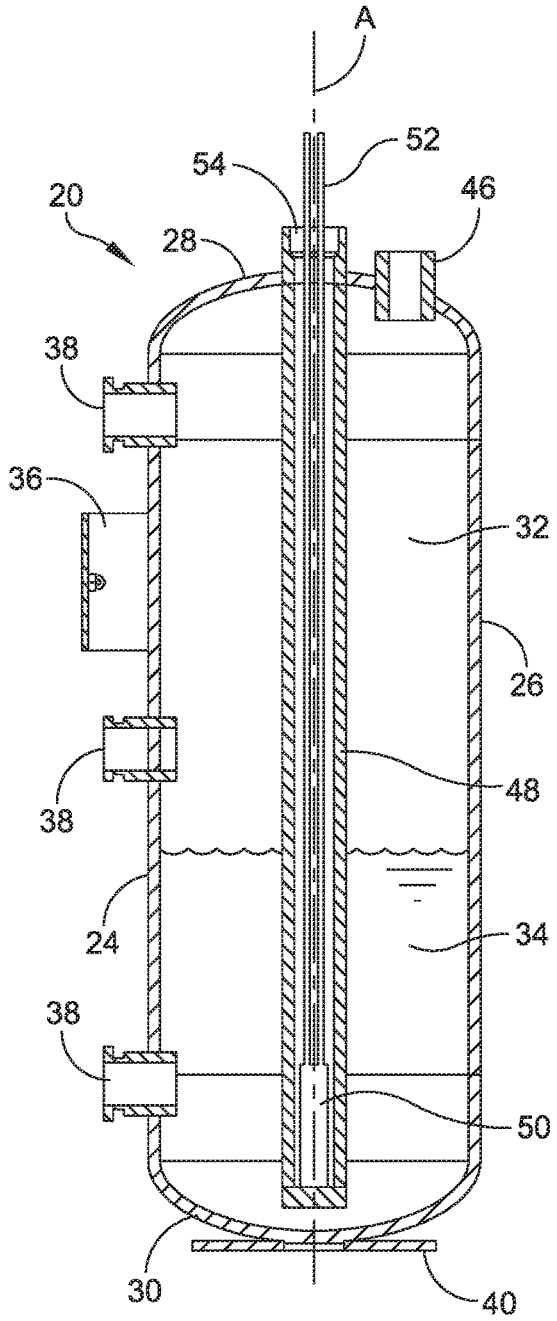
FIG. 5 is a cross-sectional view of the receiver.
Figure 6:
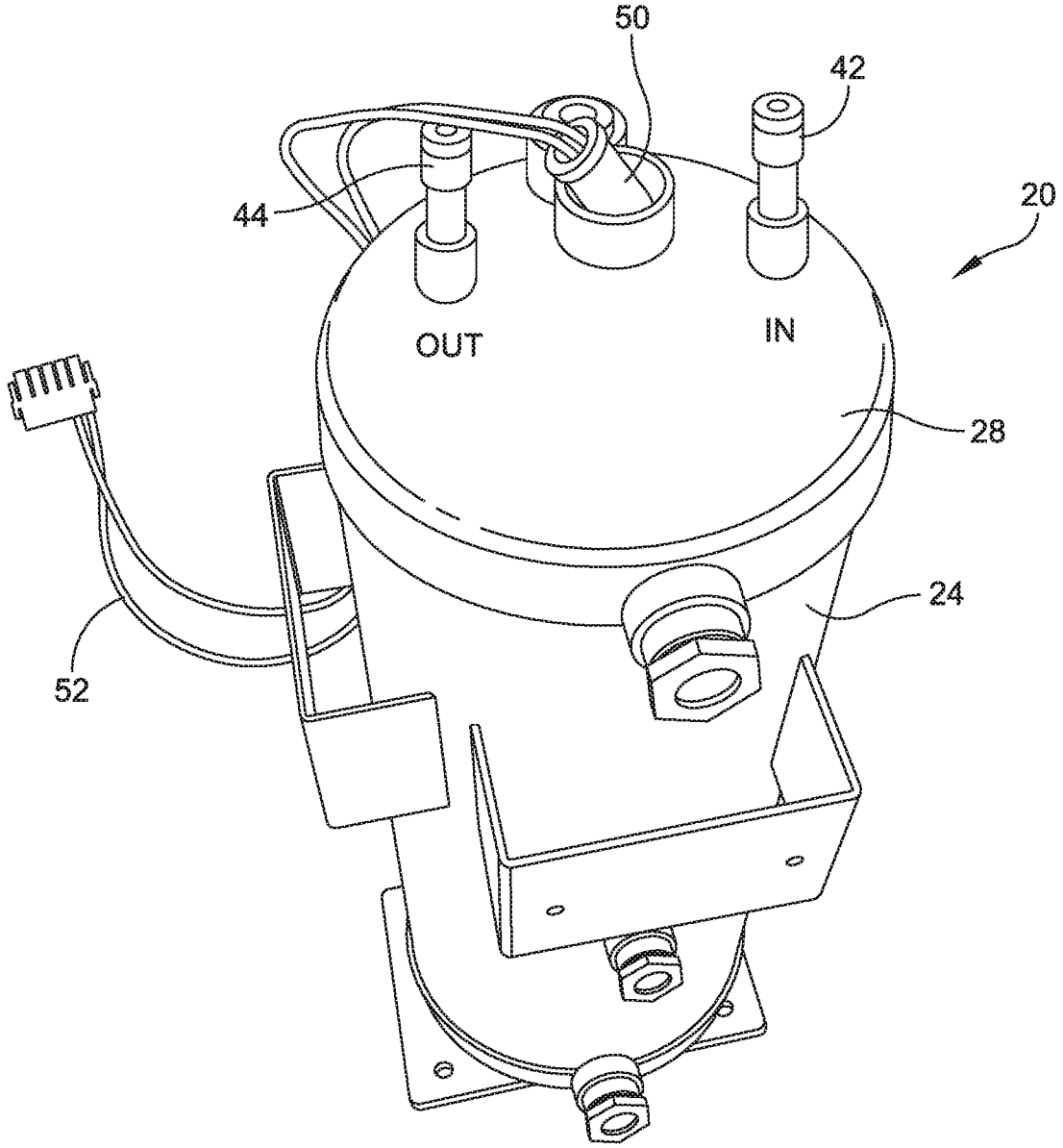
FIG. 6 is a perspective view of the receiver.

Referring additionally to FIGS. 5 and 6, the top wall 28 of the cylindrical body 24 includes an inlet 42 to deliver heat transfer fluid to the interior chamber 32 of the cylindrical body. The cylindrical body 24 further includes an outlet 44 to remove heat transfer fluid from the interior chamber 32 of the cylindrical body. Specifically, the inlet 42 is configured to receive heat transfer fluid from the DX condenser 18 of the DX cooling unit 10 and the outlet 44 is configured to deliver heat transfer fluid to the DX condenser via the compressor 14. The receiver 20 functions as a tank for storing heat transfer fluid 34 used in the DX cooling unit 10 for operating the DX condenser 18. The receiver 20 stores at least a portion of heat transfer fluid 34 depending on fluctuating changes in the pressure of the DX cooling unit 10. The top wall 28 further includes a port 46, which is provided for installing a safety valve to relieve pressure when pressure within the receiver 20 is too high.

As best shown in FIG. 5, receiver 20 further includes a heater well 48 formed to extend along a length of the cylindrical body 24 of the receiver 20. In the shown embodiment, the heater well 48 extends along a longitudinal axis A that is coaxial with an axis of the cylindrical body 24. The heater well 48 extends from the top wall 28 of the cylindrical body 24 toward the bottom wall 30 of the cylindrical body so that a bottom of the heater well is adjacent the bottom wall. The heater well 48 is blinded in that it is completely enclosed by the cylindrical body 24. It should be understood that the diameter of the heater well 48 can be varied based on the size and shape of a heating element disposed within the heater well.

The receiver 20 further includes a heater 50 that is positioned within the heater well 48. As shown, in one embodiment, the heater 50 is positioned at a bottom of the heater well 48. However, the heater 50 can be positioned anywhere along a length of the heater well 48. The heater 50 can embody any type of heating elements configured to quickly heat the heat transfer fluid 34 housed within the interior chamber 32 of the cylindrical body 24 of the receiver 20. In one embodiment, the heater 50 is a polymer positive temperature coefficient ("PTC") heating element. PTC heaters operate at a lower temperature, e.g., 500° F., to provide a safe, longer lasting and cost-efficient approach to heating the heat transfer fluid 34 disposed within the interior chamber 32 of the receiver 20. Power is delivered to the heater 50 by a heater wire or cable 52 connected to the heater. In a certain embodiment, the heater wire 52 is coupled to the controller 22 configured to control the operation of the heater 50. In one embodiment, when the DX cooling unit 10 is on standby, the controller 22 is configured to power on the heater 50 to heat the heat transfer fluid 34 contained within the interior chamber 32 of the cylindrical body 24 of the receiver 20, and when the DX cooling unit is operating, the controller is configured to power off the heater.

The heater 50 is protected from external materials entering the heater well 48 by a strain relief plug 54 configured to seal the heater well. As shown, the strain relief plug 54 encloses an upper end of the heater well 48 while allowing the heater wire 52 to pass through the strain relief plug. In certain embodiments, the strain relief plug 54 is fabricated from metal or plastic material.

Figure 7:
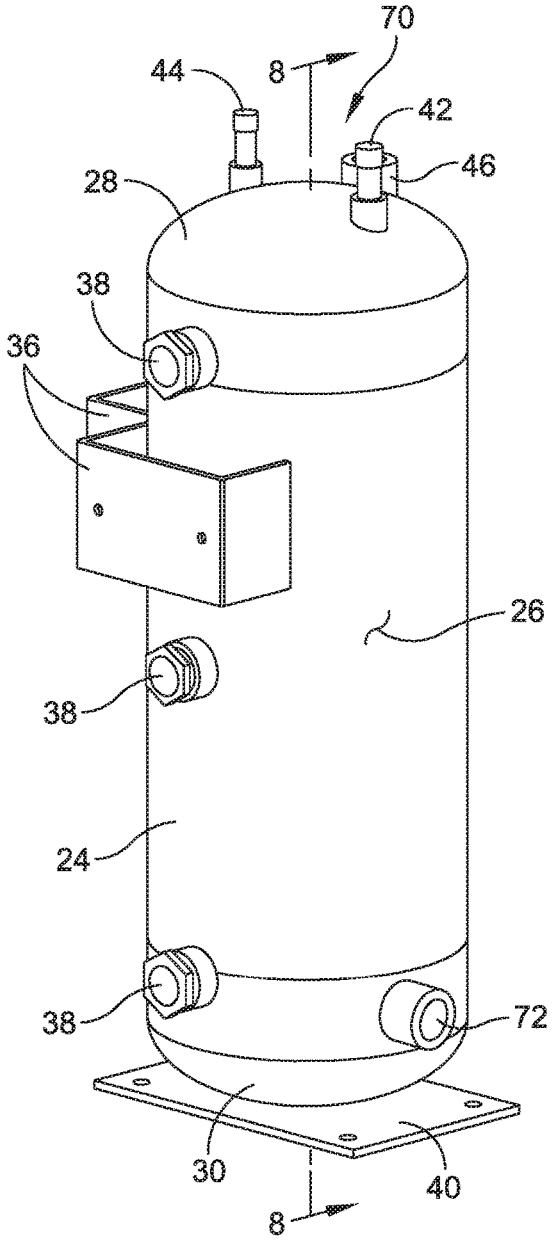
FIG. 7 is a perspective view of a receiver of another embodiment of the present disclosure.
Figure 8:
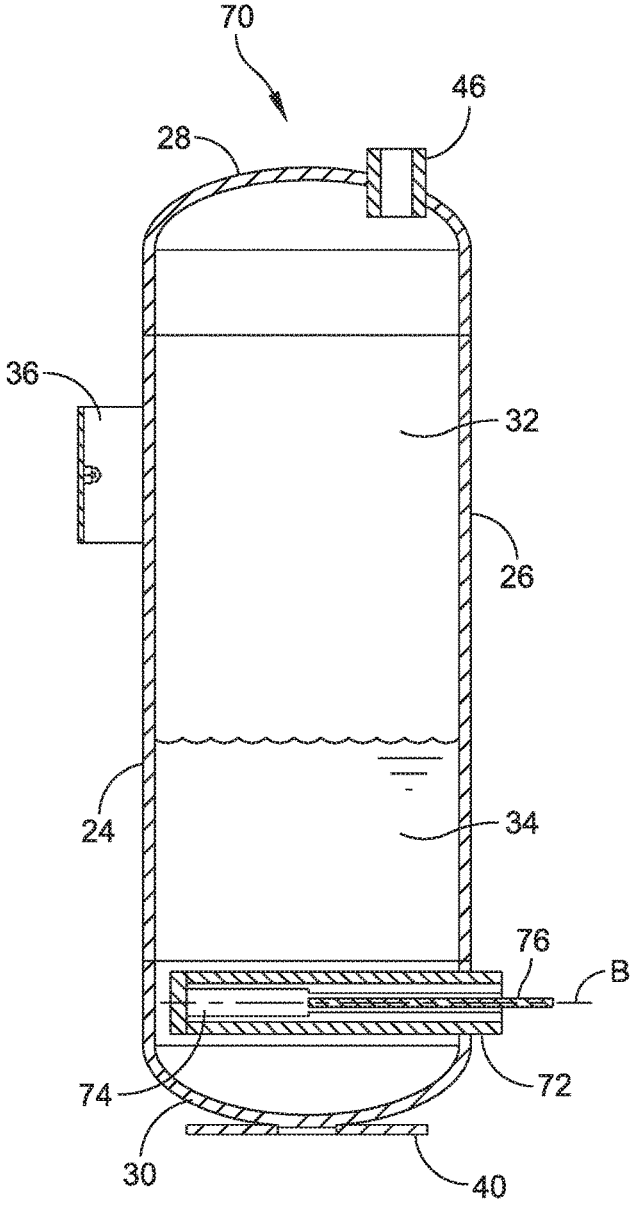
FIG. 8 is a cross-sectional view of the receiver shown in FIG. 7.

Referring to FIGS. 7 and 8, a receiver of another embodiment of the present disclosure is generally indicated at 70. As with receiver 20, receiver 70 includes a cylindrical body 24 having a cylindrical wall 26, a curved top wall 28 provided at the top of the cylindrical wall, and a curved bottom wall 30 provided at the bottom of the cylindrical wall. Together, the cylindrically wall 26, the top wall 28, and the bottom wall 30 define an interior chamber 32 (FIG. 8) that is designed to hold and store heat transfer fluid 34. As shown, the cylindrical wall 26 includes two brackets, each indicated at 36, to secure the receiver 70 to a component of the DX cooling unit 10, such as a housing of the compressor 14. The cylindrical wall 26 further includes three ports, each indicated at 38, which are provided for showing the liquid level of refrigerant. The cylindrical body 24 is mounted on a base 40 that is configured to support the cylindrical body of the receiver 70 in an upright position. The top wall 28 of the cylindrical body 24 includes an inlet 42 to deliver heat transfer fluid to the interior chamber 32 of the cylindrical body. The cylindrical body 24 further includes an outlet 44 to remove heat transfer fluid from the interior chamber 32 of the cylindrical body. The top wall 28 further includes a port 46, which is provided for installing a safety valve to relieve pressure when pressure within the receiver 70 is too high.

As best shown in FIG. 7, receiver 70 further includes a heater well 72 formed to extend horizontally adjacent the bottom wall 30 of the cylindrical body 24. In the shown embodiment, 10 the heater well 72 extends along a longitudinal axis B. The heater well 72 is blinded in that it is completely enclosed by the cylindrical body 24. It should be understood that the diameter of the heater well 72 can be varied based on the size and shape of a heating element disposed within the heater well.

The receiver 70 further includes a heater 74 that is positioned within the heater well 72. As with heater 50, the heater 74 can embody any type of heating elements configured to quickly heat the heat transfer fluid 34 housed within the interior chamber 32 of the cylindrical body 24 of the receiver 70. Power is delivered to the heater 74 by a heater wire or cable 76 connected to the heater. In a certain embodiment, the heater wire 76 is coupled to the controller 22 configured to control the operation of the heater 74. In one embodiment, when the DX cooling unit 10 is on standby, the controller 22 is configured to power on the heater 74 to heat the heat transfer fluid 34 contained within the interior chamber 32 of the cylindrical body 24 of the receiver 70, and when the DX cooling unit is operating, the controller is configured to power off the heater. As with heater 50, the heater 74 can be protected from external materials entering the heater well 72 by a strain relief plug (not shown) configured to seal the heater well.

As described herein, the receivers of embodiments of the present disclosure provide a heater solution that reduces installation time and cost since a service technician installing the receiver does not need to wrap heat tape about the receiver. The service technician need only insert the heater into the heater well and connect the power wire to the controller. The blinded well is then sealed by installing the strain relief plug. Thus, the heat generated by the heater is absorbed by the heat transfer fluid contained within the interior chamber of the cylindrical body of the receiver.

The aspects disclosed herein in accordance with the present invention, are not limited in their application to the details of construction and the arrangement of components set forth in the following description or illustrated in the accompanying drawings. These aspects are capable of assuming other embodiments and of being practiced or of being carried out in various ways. Examples of specific implementations are provided herein for illustrative purposes only and are not intended to be limiting. In particular, acts, components, elements, and features discussed in connection with any one or more embodiments are not intended to be excluded from a similar role in any other embodiments.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. In addition, in the event of inconsistent usages of terms between this document and documents incorporated herein by reference, the term usage in the incorporated reference is supplementary to that of this document; for irreconcilable inconsistencies, the term usage in this document controls.

Having thus described several aspects of at least one example, it is to be appreciated that various alterations, modifications, and improvements will readily occur to those skilled in the art. For instance, examples disclosed herein may also be used in other contexts. Such alterations, modifications, and improvements are intended to be part of this disclosure, and are intended to be within the scope of the examples discussed herein. Accordingly, the foregoing description and drawings are by way of example only.

What is claimed is:

1. A receiver of a cooling unit, the receiver comprising:

a cylindrical body having a cylindrical wall that defines an interior chamber, a bottom wall formed with the cylindrical wall, and a top wall formed with the cylindrical wall;

an inlet provided in the cylindrical body;

an outlet provided in the cylindrical body;

a heater well having a cylindrical form disposed within the cylindrical body; and a heater positioned in the heater well to selectively heat a heat transfer fluid contained within the interior chamber of the cylindrical body, wherein the heater well extends from the top wall to adjacent the bottom wall along an axis that is coaxial with an axis of the cylindrical wall of the cylindrical body, and wherein the heater is configured to be coupled to a controller, the controller being configured to control the operation of the heater in such a manner that when the cooling unit is on standby, the controller is configured to power on the heater to heat the heat transfer fluid contained within the interior chamber of the cylindrical body of the receiver, and when the cooling unit is operating, the controller is configured to power off the heater.

2. The receiver of claim 1, wherein the heater is positioned at a bottom of the heater well.

3. The receiver of claim 1, wherein the heater is a polymer positive temperature coefficient heating element.

4. The receiver of claim 1, further comprising a heater wire connected to the heater and the controller, and configured to power the heater.

5. The receiver of claim 1, further comprising a strain relief plug configured to seal the heater well.

6. The receiver of claim 5, wherein the inlet is provided in the top wall and the outlet is provided in the top wall.

7. A method of selectively heating heat transfer fluid in a receiver of a cooling unit, the method comprising:

providing a receiver including a cylindrical body having a cylindrical wall that defines an interior chamber, a bottom wall formed with the cylindrical wall, and a top wall formed with the cylindrical wall, an inlet provided in the cylindrical body, an outlet provided in the cylindrical body, and a heater well having a cylindrical form disposed within the cylindrical body;

positioning a heater in the heater well;

selectively powering the heater to heat a heat transfer fluid contained in the receiver, wherein the heater well extends from the top wall to adjacent the bottom wall along an axis that is coaxial with an axis of the cylindrical wall of the cylindrical body; and controlling the operation of the heater in such a manner that when the cooling unit is on standby, the controller is configured to power on the heater to heat the heat transfer fluid contained within the interior chamber of the cylindrical body of the receiver, and when the cooling unit is operating, the controller is configured to power off the heater.

8. The method of claim 7, wherein the heater is positioned at a bottom of the heater well.

9. The method of claim 7, wherein the heater is a polymer positive temperature coefficient heating element.

10. The method of claim 7, further comprising connecting the heater to a heater wire to provide power the heater.

11. The method of claim 10, further comprising connecting the heater wire to the controller configured to control the operation of the heater.

12. The method of claim 7, further comprising sealing the heater well with a strain relief plug configured to seal the heater well.

13. The receiver of claim 12, wherein the inlet is provided in the top wall and the outlet is provided in the top wall.

14. A cooling unit comprising:

a housing;

a compressor supported by the housing;

a condenser supported by the housing and in fluid communication with the compressor; and a receiver supported by the housing and in fluid communication with the compressor and the condenser, the receiver including a cylindrical body having a cylindrical wall that defines an interior chamber, a bottom wall formed with the cylindrical wall, and a top wall formed with the cylindrical wall, an inlet provided in the cylindrical body, an outlet provided in the cylindrical body, a heater well having cylindrical form disposed within the cylindrical body, a heater positioned in the heater well to selectively heat a heat transfer fluid contained within the interior chamber of the cylindrical body, wherein the heater well extends from the top wall to adjacent the bottom wall along an axis that is coaxial with an axis of the cylindrical wall of the cylindrical body, a heater wire connected to the heater and configured to power the heater, the heater wire being connected to a controller configured to control the operation of the heater to selectively heat a heat transfer fluid contained within the interior chamber of the cylindrical body, and a strain relief plug configured to seal the heater well, wherein the controller is configured to control the operation of the heater in such a manner that when the cooling unit is on standby, the controller is configured to power on the heater to heat the heat transfer fluid contained within the interior chamber of the cylindrical body of the receiver, and when the cooling unit is operating, the controller is configured to power off the heater.

15. The cooling unit of claim 14, wherein is positioned at a bottom of the heater well, the heater being a polymer positive temperature coefficient heating element.

* * * * *